US009830786B2

(12) United States Patent
Lee et al.

(10) Patent No.: US 9,830,786 B2
(45) Date of Patent: Nov. 28, 2017

(54) INTRUSION SENSING APPARATUS FOR SECURITY FENCE

(71) Applicant: GES CO., LTD., Seongnam-si (KR)

(72) Inventors: Yong-Cheol Lee, Yongin-si (KR); Woo-Young Jang, Gwangju-si (KR)

(73) Assignee: GES CO., LTD., Seongnam-si (KR)

( * ) Notice: Subject to any disclaimer, the term of this patent is extended or adjusted under 35 U.S.C. 154(b) by 0 days.

(21) Appl. No.: 15/304,188

(22) PCT Filed: Oct. 22, 2014

(86) PCT No.: PCT/KR2014/009959
§ 371 (c)(1),
(2) Date: Oct. 14, 2016

(87) PCT Pub. No.: WO2015/163549
PCT Pub. Date: Oct. 29, 2015

(65) Prior Publication Data

US 2017/0039825 A1 Feb. 9, 2017

(30) Foreign Application Priority Data

Apr. 24, 2014 (KR) ..... 10-2014-0049531

(51) Int. Cl.
*G08B 13/00* (2006.01)
*G08B 13/12* (2006.01)

(52) U.S. Cl.
CPC ..... *G08B 13/122* (2013.01)

(58) Field of Classification Search
CPC ..... G08B 13/122; G08B 13/12; E04H 17/00
USPC ..... 340/541, 506, 564, 566, 568.2
See application file for complete search history.

(56) References Cited

U.S. PATENT DOCUMENTS

2003/0020610 A1* 1/2003 Swanson ..... G08B 13/1609 340/566
2006/0054796 A1* 3/2006 Chun ..... G08B 13/186 250/227.15
2006/0197665 A1* 9/2006 Shibata ..... G08B 13/124 340/557
2008/0111687 A1* 5/2008 Husmann ..... G08B 15/02 340/552
2008/0238671 A1* 10/2008 Woosnam ..... H04H 20/02 340/566

(Continued)

FOREIGN PATENT DOCUMENTS

JP 2011-27666 A 2/2011
JP 2014-53673 A 3/2014

(Continued)

OTHER PUBLICATIONS

International Search Report dated Jan. 12, 2015 in counterpart International Application No. PCT/KR2014/009959 (7 pages in Korean with English translation).

*Primary Examiner* — Phung Nguyen
(74) *Attorney, Agent, or Firm* — NSIP Law

(57) ABSTRACT

The present invention provides an intrusion sensing apparatus for a security fence, the apparatus detecting the distribution characteristic of a frequency component of an output signal in a charge amplifier connected to a shielding multi-core cable united with a security fence, and thereby determining whether the output signal is a signal caused by the overall vibration of and a partial impact on the security fence.

5 Claims, 6 Drawing Sheets

(56) References Cited

U.S. PATENT DOCUMENTS

| | | | | |
|---|---|---|---|---|
| 2011/0227731 | A1* | 9/2011 | Iffergan | F41H 11/05 340/541 |
| 2013/0304415 | A1* | 11/2013 | Bomparet | G08B 13/122 702/150 |

FOREIGN PATENT DOCUMENTS

| | | | |
|---|---|---|---|
| KR | 10-0933947 | B1 | 12/2009 |
| KR | 10-0966299 | B1 | 6/2010 |
| KR | 10-1088418 | B1 | 12/2011 |

* cited by examiner

INTRUSION SENSING APPARATUS FOR SECURITY FENCE

CROSS REFERENCE TO RELATED APPLICATION(S)

This application is a National Phase entry of PCT Application No. PCT/KR2014/009959, filed on Oct. 22, 2014, which claims priority under 35 U.S. C. §119(e), 120 and 365(c) to Korean Patent Application No. 10-2014-0049531, filed on Apr. 24, 2014, in the Korean Intellectual Property Office, the entire disclosures of each of which are incorporated herein by reference for all purposes.

TECHNICAL FIELD

The present invention relates to an intrusion sensing apparatus for a security fence and, more particularly, to an intrusion sensing apparatus for a security fence, which determines a corresponding signal is a signal attributable to overall vibration and a partial impact of an security fence by detecting a distribution characteristic of the frequency components of an output signal of a charge amplifier connected to a shielded multicore cable connected to the security fence.

BACKGROUND ART

Recently, as security importance of the security facilities of a nation's major organization or of major industry facilities for maintaining security and crime prevention according to the specialization of each industry field is strengthened, the construction of a thorough security system grafted to a high-tech technology emerges as an absolute subject in public institutes, companies and government.

Furthermore, for efficient manpower and expense management, the government, companies, etc. of each nation want to construct a security system that has been advanced in order to achieve the subject using minimum security guard manpower.

Such a security system includes a locking device installed at a location for an entrance to a building, such as an entrance and a window, a system for enabling the mechanical operation of a crime prevention lattice, an electronic monitoring device, such as a camera and a crime prevention sensor for monitoring the intrusion of an intruder. In particular, as an interest in a crime prevention system recently increases, there has been provided a system in which a security camera, a security sensor, etc. detects the intrusion of an external intruder and notifies a security guard company, etc. of such detection so that the staff of a security guard company is dispatched.

Furthermore, in order to strength the security of a specific area, security is enhanced by installing a fence and installing a specific alarm system on the fence.

FIG. 1 is a block diagram showing the cable connection state of an intrusion sensing apparatus using a common shielded multicore cable.

As shown in FIG. 1, in the intrusion sensing apparatus 10 according to a conventional technology, a shielded multicore cable 1 for detecting an electrostatic force is connected to an analog sensor unit (ASU) 6 via a connection cable 5.

Furthermore, a terminal device 2 is finished at the end of the shielded multicore cable 1. A branch sleeve 3 is connected between the shielded multicore cables 1. The shielded multicore cable 1 and the connection cable 5 is connected by a cable adapter 4. The connection cable 5 is connected to the analog sensor unit 6.

FIG. 2 is an exemplary diagram showing the state in which the intrusion sensing apparatus using the shielded multicore cable according to a conventional technology is used in a security fence.

As shown in FIG. 2, the shielded multicore cables 1 have been installed in several fences 20 installed on the outer wall. The shielded multicore cables 1 are connected to the analog sensor unit 6 through the connection cable. When an electrostatic force from the shield multicore cables 1 is detected, the analog sensor unit 6 outputs an alarm signal to a management system disposed in a remote situation room, etc.

Korean Patent No. 10-1046635 (entitled "SYSTEM AND METHOD FOR SENSING INVASION OF SECURITY FENCE") proposes a security fence intrusion sensing system in which a plurality of sensing modules connected to a data cable is attached to a security fence at specific intervals, a sensing module attached to the security fence detects vibration when an intrusion is generated through the security fence, and a network control module determines whether the intrusion has occurred, the location of the intrusion, and the type of intrusion based on the sensed information and sends the results of the determination to a monitoring situation room.

However, such an intrusion sensing system according to a conventional technology malfunctions due to an external natural environment, such as the wind, rainy weather and/or a change of weather, depending on the location where a security sensor is installed and the state of a physical fence, and thus has problems in that reliability of a security system is reduced and an efficient operation is hindered.

DISCLOSURE

Technical Problem

In order to solve such problems, an object of the present invention is to provide an intrusion sensing apparatus for a security fence, which determines a corresponding signal is a signal attributable to overall vibration and a partial impact of an security fence by detecting a distribution characteristic of the frequency components of an output signal of a charge amplifier connected to a shielded multicore cable connected to the security fence.

Technical Solution

In order to achieve the above object, the present invention relates to an intrusion sensing apparatus for a security fence, including a charge amplifier which amplifies an amount of charges generated by friction electrification within a shielded multicore cable and outputs the amplified signal in the form of a voltage through an active filter; a signal conversion unit which receives the signal output by the charge amplifier, converts the amplitude of the received signal so that the amplitude is enlarged or reduced in a specific size, samples the converted signal, and detects a frequency component; a feature frequency extraction unit which detects a frequency signal having a feature different from a feature of a frequency signal of a predetermined charged signal by analyzing the frequency component detected by the signal conversion unit; and an intrusion determination unit which determines whether the feature frequency signal detected by the feature frequency extraction unit is vibration or an intrusion by comparing the feature frequency signal with a predetermined frequency signal for a vibration determination and a predetermined frequency signal for an intrusion determination.

Furthermore, the signal conversion unit according to the present invention includes an ADC which receives the signal output by the charge amplifier into a digital signal and outputs the digital signal; a scaler which converts the amplitude of the digital signal converted by the ADC based on predetermined environment information by enlarging or reducing the amplitude of the digital signal based on predetermined environment information so that the frequency component of the digital signal is not changed and outputs the enlarged or reduced signal; a Fourier transform unit which detects a frequency component in the converted signal enlarged or reduced by the scaler; and a transform management unit which outputs a conversion signal for guaranteeing the accuracy of a frequency analysis to the ADC in a specific cycle, analyzes the amplitude of the signal output by the scaler, and controls the Fourier transform unit so that the Fourier transform unit operates if the analyzed amplitude exceeds a predetermined threshold value. Furthermore, when a signal belonging to signals output by the ADC and continuing to be generated for a specific time is received, the scaler according to the present invention calculates an average amplitude value of the input signals, reduces an amplitude value of the input signal by the calculated average amplitude value, and outputs the reduced signal.

Furthermore, the transform management unit according to the present invention sets a range of the threshold value by taking into consideration size information f an electrostatic force according to a natural environment. Furthermore, the frequency signal for a vibration determination and the frequency signal for an intrusion determination of the intrusion determination unit according to the present invention is a frequency signal modeled depending on a type of a predetermined security fence.

Advantageous Effects

The present invention has an advantage in that it can prevent output of an erroneous alarm by determining fence vibration attributable to a natural phenomenon, such as the wind and a heavy rain.

Furthermore, the present invention has an advantage in that it can prevent an erroneous alarm from being generated due to vibration generated by large-size transfer means, such as a tank, a truck or heavy equipment that moves at a short distance from a fence or the vibration of a fence generated by a flight vehicle that flies at a low altitude.

Furthermore, the present invention has an advantage in that it can improve real-time alarm performance and reliability of an intrusion alarm by preventing an erroneous alarm through control of a signal inputted based on real-time weather information.

MODE FOR INVENTION

Figure 1:
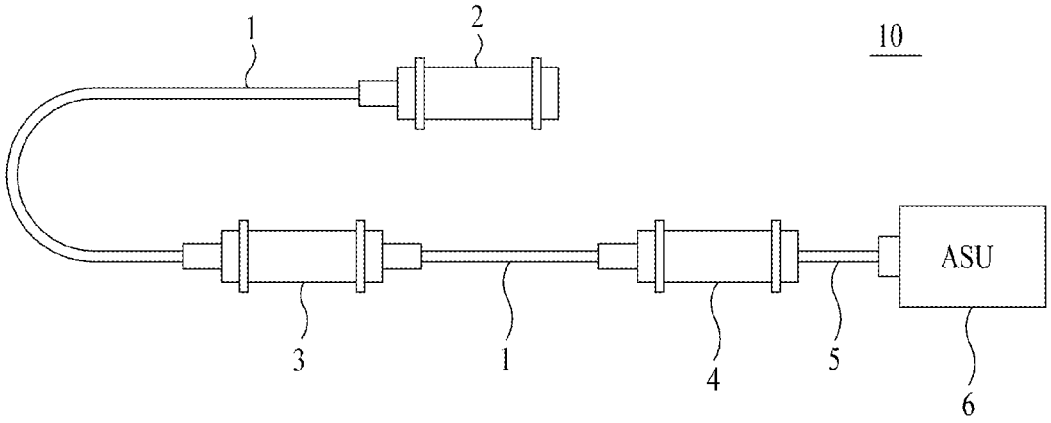
FIG. 1 is a block diagram showing the cable connection state of an intrusion sensing apparatus using a common shielded multicore cable.
Figure 2:
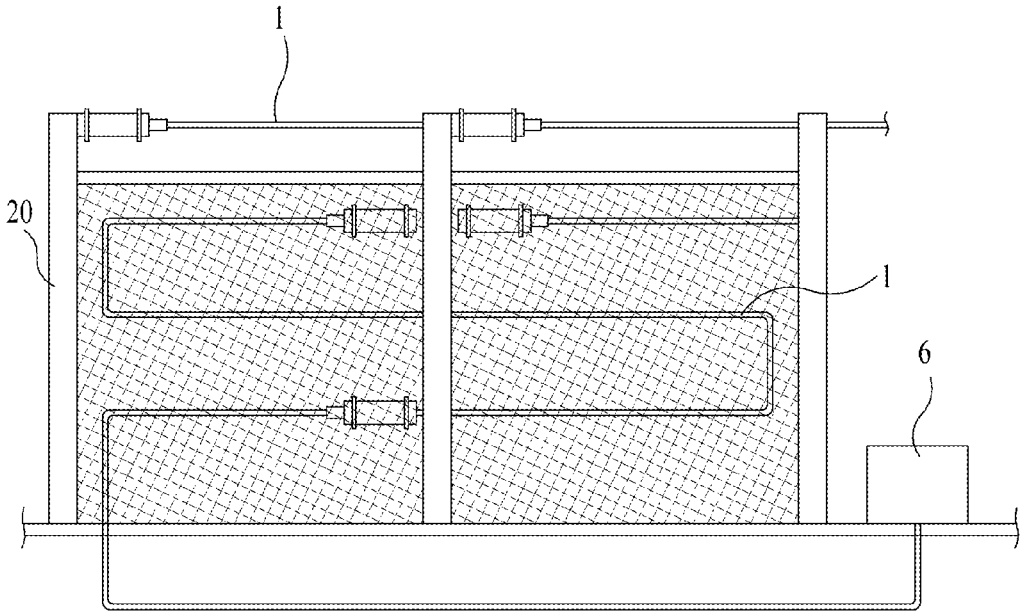
FIG. 2 is an exemplary diagram showing the state in which the intrusion sensing apparatus using a shielded multicore cable according to a conventional technology is used in a security fence.
Figure 3:
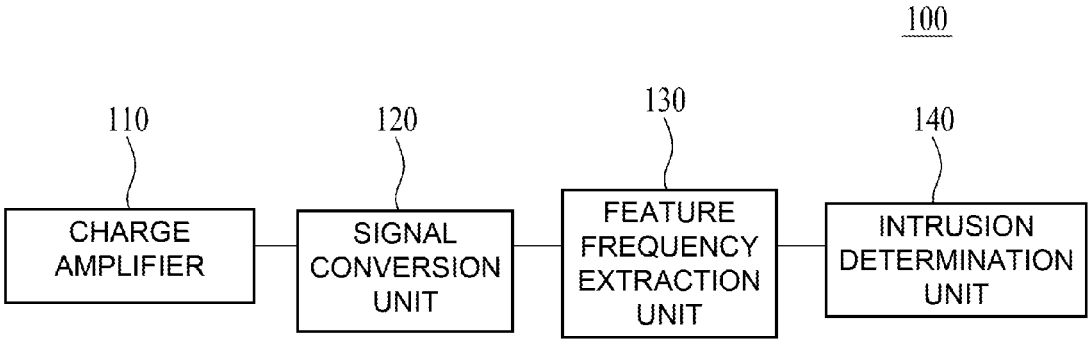
FIG. 3 is a block diagram showing the configuration of an intrusion sensing apparatus for a security fence according to the present invention.
Figure 4:
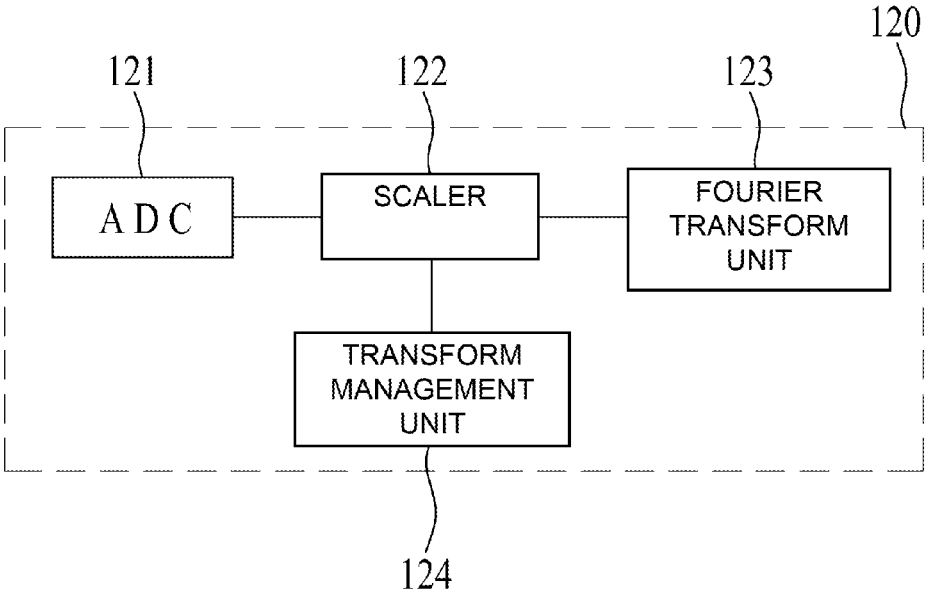
FIG. 4 is a block diagram showing the configuration of the signal conversion unit of the intrusion sensing apparatus for a security fence according to FIG. 3.

A preferred embodiment of an intrusion sensing apparatus for a security fence according to the present invention is described below in detail with reference to the accompanying drawings. FIG. 3 is a block diagram showing the configuration of an intrusion sensing apparatus for a security fence according to the present invention. FIG. 4 is a block diagram showing the configuration of the signal conversion unit of the intrusion sensing apparatus for a security fence according to FIG. 3.

As shown in FIGS. 3 and 4, the intrusion sensing apparatus 100 for a security fence according to the present invention is configured to include a charge amplifier 110, a signal conversion unit 120, a feature frequency extraction unit 130 and an intrusion determination unit 140 in order to determine whether a corresponding signal is a signal attributable to overall vibration and a partial impact of a security fence by detecting a distribution characteristic of the frequency components of an output signal of the charge amplifier connected to a shielded multicore cable.

The charge amplifier 110 is connected to an analog sensor unit for detecting a signal generated due to friction electrification within a shielded multicore cable having a varying electromotive force when an external force or impact is applied, amplifies the amount of charges of a signal detected by the analog sensor unit, and outputs the amplified signal in the form of a voltage through an active filter.

The signal conversion unit 120 is an element for receiving a signal output by the charge amplifier 110, converting the amplitude of the received signal by enlarging or reducing the amplitude of the received signal in a specific size, sampling the converted signal, and detecting a frequency component. The signal conversion unit 120 is configured to include an analog to digital converter (ADC) 121, a scaler 122, a Fourier transform unit 123 and a transform management unit 124.

The ADC 121 receives a signal from the charge amplifier 110, converts the received signal into a digital signal, and outputs the digital signal.

The scaler 122 is an element for converting the amplitude of the digital signal converted by the ADC 121 based on predetermined environment information by enlarging or reducing the amplitude of the digital signal so that the frequency component of the digital signal is not changed. When a signal that belongs to signals output by the ADC 121 and that continues to be generated for a specific time is received, the scaler 122 calculates an average amplitude value of the input signals, reduces the amplitude value of the input signal by a difference of the calculated average amplitude value, and outputs the reduced signal.

That is, a shielded multicore cable installed on a security fence generates vibration due to a natural environment condition, such as a natural wind and/or a rainfall. When the security fence is vibrated due to the environment condition, the output signal of the charge amplifier 110 attributable to the vibration is influenced by the direction and speed of a wind at a location where the security fence has been installed. Accordingly, in order to remove a noise signal attributable to a natural phenomenon from the output signal of the charge amplifier 110 without the distortion of a frequency component, the amplitude value of the signal converted by the ADC L21 is proportionally enlarged or reduced, converted, and output.

The Fourier transform unit 123 is an element for sampling the converted signal enlarged or reduced by the scaler 122, transforming the sampled signal into a frequency component, and outputting the frequency component. The Fourier transform unit 123 digitizes a spectrum and amplitude having resolution of 0.25 Hz. That is, when the Fourier transform unit 123 performs $2^n$ pieces of sampling on an input signal, for example, sample data from a sampling start time to a sampling end time is calculated.

The Fourier transform unit 123 calculates the value of each frequency by performing high-speed Fourier transform on the calculated sampling data in real time. A frequency value [f(max)] having a maximum size between the start time and end time of each unit time and a corresponding voltage value are stored.

The transform management unit 124 outputs a conversion signal for guaranteeing the accuracy of a frequency analysis to the ADC 121 at a specific interval. If the range of a predetermined threshold value is exceeded as a result of the analysis of the amplitude of a signal output by the scaler 122, the transform management unit 124 controls the Fourier transform unit 123 so that it operates.

That is, the transform management unit 124 outputs a conversion signal for the start of conversion (SoC) of the ADC 121 for a predetermined specific time in order to sample the signal in each specific cycle in order to guarantee the analysis accuracy of a frequency component.

Furthermore, the transform management unit 124 sets the range of a threshold value by taking into consideration information about the size of an electrostatic force (the amplitude of a signal) according to natural environment information (e.g., wind, temperature and/or rainfall information) set by a user.

That is, in order to prevent an unnecessary signal from being detected when a security fence is vibrated under the influence of a wind, the range of a maximum threshold value and a minimum threshold value of amplitude is changed. Furthermore, the intrusion sensing apparatus may be configured to be automatically controlled when pieces of condition information are received in order to prevent a malfunction signal from being detected because a security fence is vibrated depending on the type of security fence and characteristics, such as a wind, a temperature, a rainfall in an installation area.

The feature frequency extraction unit 130 is an element for detecting a frequency signal having a feature different from that of the frequency signal of a predetermined charged signal by analyzing a frequency component detected by the signal conversion unit 120. If a security fence is widely vibrated due to a natural phenomenon, the feature frequency extraction unit 130 extracts a feature frequency signal whose vibration and an impact can be distinguished from a charge signal charged within a shielded multicore cable due to an impact of a narrow rage because the charge signal has a different frequency feature.

The feature frequency includes a frequency value [f(max)] having a maximum size, a frequency value [f(max−1)] having a second size, a frequency value [f(max−2)] having a third size, and a frequency value [f(max−3)] having a fourth size.

Figure 5A:
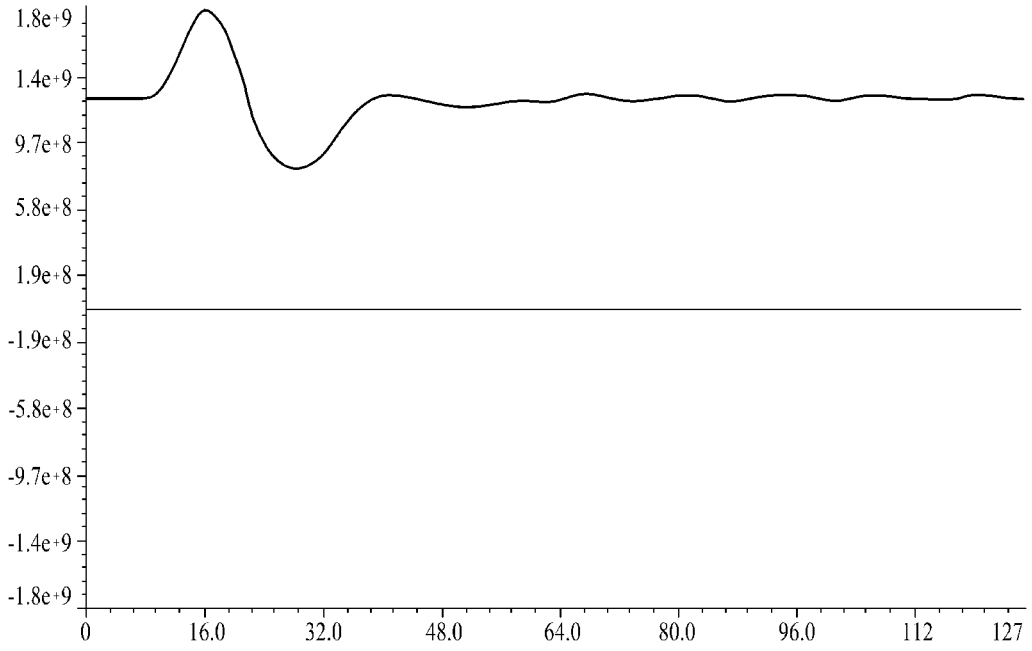
FIGS. 5A and 5B are graphs showing an output signal when an intrusion is generated in the intrusion sensing apparatus for a security fence according to FIG. 3.
Figure 5B:
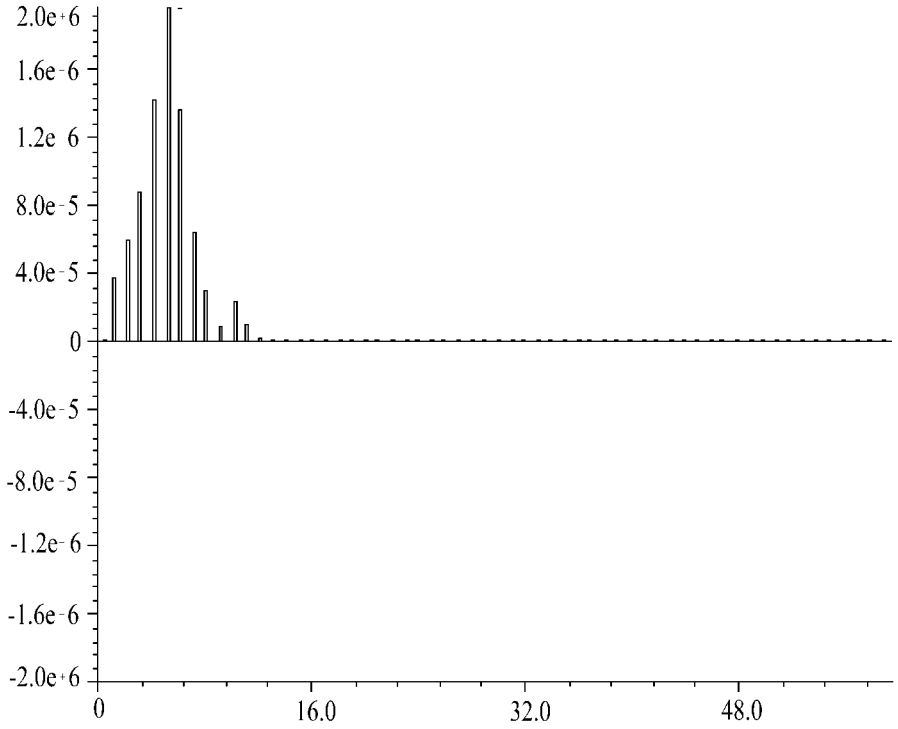

FIGS. 5A and 5B show the output signal of the charge amplifier upon impact (intrusion) and show that the output signal of the charge amplifier attributable to an impact has a dense distribution of f(max−1), f(max−2) and f(max−3) frequencies near a frequency f(max) having a maximum value.

Figure 6A:
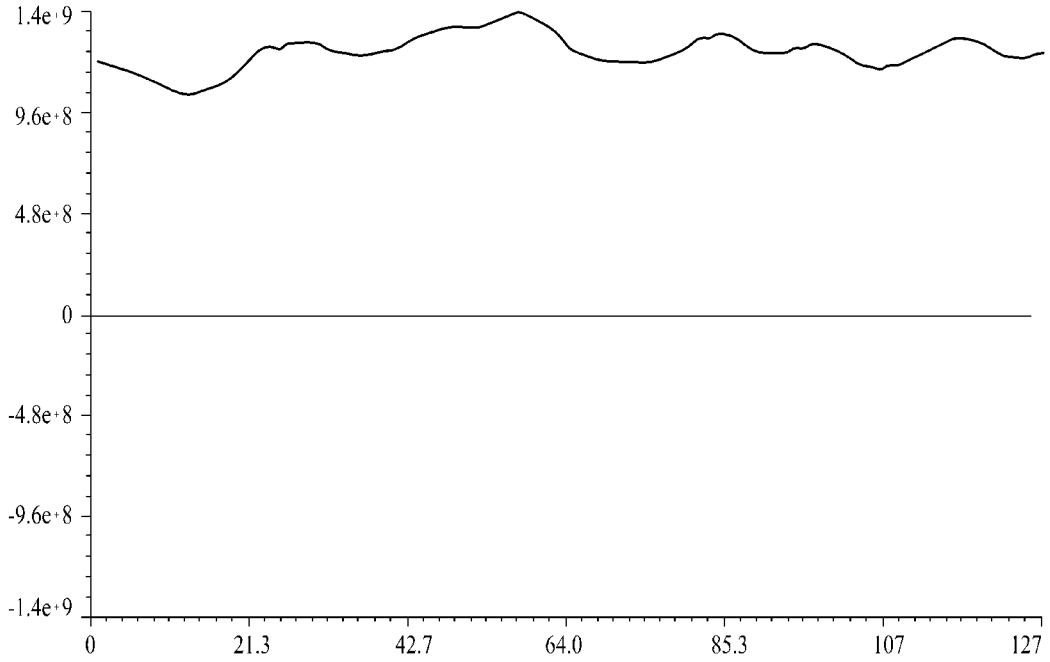
FIGS. 6A and 6B are graphs showing an output signal when vibration is generated in the intrusion sensing apparatus for a security fence according to FIG. 3.
Figure 6B:
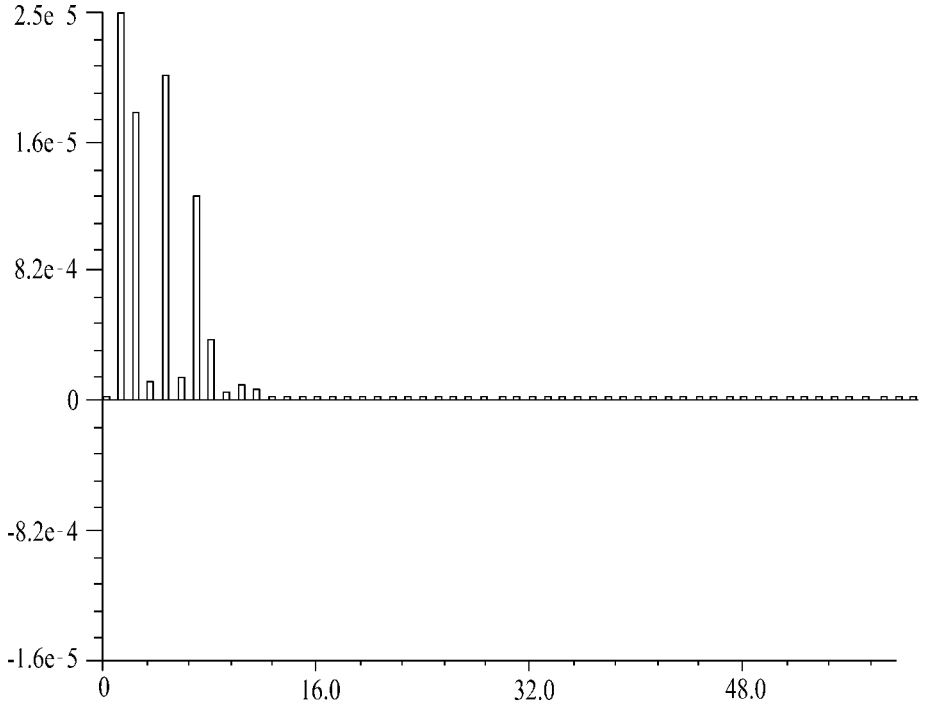

Furthermore, FIGS. 6A and 6B show the output signal of the charge amplifier upon vibration and show that the output signal of the charge amplifier has a dense distribution of frequency values f(max−1), f(max−2) and f(max−3) frequencies when vibration attributable to a wind is generated.

The intrusion determination unit 140 determines whether a feature frequency signal detected by the feature frequency extraction unit 130 is vibration or an intrusion by comparing the feature frequency signal with a predetermined frequency signal for a vibration determination and a predetermined frequency signal for an intrusion determination.

That is, the frequency signal for a vibration determination and the frequency signal for an intrusion determination are values stored by analyzing a distribution characteristic of frequencies based on modeling depending on the type of security fence. The intrusion determination unit 140 arranges the frequency values based on the output signal of the charge amplifier, compares the frequency values with the modeled value, and determines whether the signal output by the charge amplifier is a signal generated due to an intrusion or vibration generated by a wind, etc based on a result of the comparison.

Furthermore, the frequency signal for a vibration determination and the frequency signal for an intrusion determination are frequency signals modeled depending on the type of predetermined security fence.

Accordingly, when a security fence is vibrated, a distribution characteristic of feature frequencies different depending on the installation state of the security fence are extracted, a comparison is performed on the feature frequencies in a real time, and whether the vibration corresponds to an impact attributable to an intrusion or vibration attributable to a natural environment. Accordingly, a malfunction and erroneous alarm of a fence intrusion sensing system can be prevented.

As described above, although a preferred embodiment of the present invention has been described, those skilled in the art may understand that the present invention may be modified and changed in various ways without departing from the spirit and scope of the present invention written in the following claims.

Furthermore, the thickness of the lines, the size of the elements, etc. shown in the process of describing the embodiment of the present invention may have been exaggerated for the clarity of a description and for convenience' sake. The aforementioned terms are terms defined by taking functions in the present invention into consideration, and may be different depending on an operator's intention or usage.

Accordingly, such terms should be analyzed based on the overall contents of the specification.

DESCRIPTION OF REFERENCE NUMERALS

100 Intrusion sensing apparatus
110 Charge amplifier
120 Signal conversion unit
121 ADC
122 Scaler
123 Fourier transform unit
124 Transform management unit

130 Feature frequency extraction unit

140 Intrusion determination unit

The invention claimed is:

1. An intrusion sensing apparatus for a security fence, comprising:

a charge amplifier which amplifies an amount of charges generated by friction electrification within a shielded multicore cable and outputs the amplified signal in a form of a voltage through an active filter;

a signal conversion unit which receives the signal output by the charge amplifier, converts an amplitude of the received signal so that the amplitude is enlarged or reduced in a specific size, samples the converted signal, and detects a frequency component;

a feature frequency extraction unit which detects a frequency signal having a feature different from a feature of the frequency signal of a predetermined charged signal by analyzing the frequency component detected by the signal conversion unit; and an intrusion determination unit which determines whether the feature frequency signal detected by the feature frequency extraction unit is vibration or an intrusion by comparing the feature frequency signal with a predetermined frequency signal for a vibration determination and a predetermined frequency signal for an intrusion determination.

2. The intrusion sensing apparatus of claim 1, wherein the signal conversion unit comprises:

an ADC which receives the signal output by the charge amplifier into a digital signal and outputs the digital signal;

a scaler which converts an amplitude of the digital signal converted by the ADC based on predetermined environment information by enlarging or reducing the amplitude of the digital signal based on predetermined environment information so that the frequency component of the digital signal is not changed and outputs the enlarged or reduced signal;

a Fourier transform unit which detects the frequency component in the converted signal enlarged or reduced by the scaler; and a transform management unit which outputs a conversion signal for guaranteeing accuracy of a frequency analysis to the ADC in a specific cycle, analyzes the amplitude of the signal output by the scaler, and controls the Fourier transform unit so that the Fourier transform unit operates if the analyzed amplitude exceeds a predetermined threshold value.

3. The intrusion sensing apparatus of claim 2, wherein when a signal belonging to signals output by the ADC and continuing to be generated for a specific time is received, the scaler calculates an average amplitude value of the input signals, reduces an amplitude value of the input signal by the calculated average amplitude value, and outputs the reduced signal.

4. The intrusion sensing apparatus of claim 2, wherein the transform management unit sets a range of the threshold value by taking into consideration size information f an electrostatic force according to a natural environment.

5. The intrusion sensing apparatus of claim 1, wherein the frequency signal for the vibration determination and the frequency signal for the intrusion determination of the intrusion determination unit is a frequency signal modeled depending on a type of a predetermined security fence.

* * * * *